US005139729A

United States Patent [19]

Clark, III et al.

[11] Patent Number: 5,139,729

[45] Date of Patent: Aug. 18, 1992

[54] PROCESS FOR MAKING LOW SHRINKAGE, HIGH TENACITY POLY(EPSILON-CAPROAMIDE) YARN

[75] Inventors: Thomas R. Clark, III; Joseph A. Cofer, Jr., both of Hixson; Alan R. Mochel, Signal Mountain, all of Tenn.

[73] Assignee: E. I. Du Pont de Nemours and Comapny, Wilmington, Del.

[21] Appl. No.: 802,395

[22] Filed: Dec. 4, 1991

Related U.S. Application Data

[62] Division of Ser. No. 424,847, Oct. 20, 1989, Pat. No. 5,104,969.

[51] Int. Cl.[5] ..... D02J 1/22

[52] U.S. Cl. ..... 264/289.6; 264/290.5

[58] Field of Search ..... 264/289.6, 290.5, 290.7, 264/235.6, 210.7, 210.8

[56] References Cited

U.S. PATENT DOCUMENTS

| | | | |
|---|---|---|---|
| 3,124,632 | 3/1964 | Larkin et al. | 264/290.5 |
| 3,311,691 | 3/1967 | Good | 264/290.7 |
| 4,758,472 | 7/1988 | Kitamura et al. | 428/364 |

FOREIGN PATENT DOCUMENTS

| | | |
|---|---|---|
| 62-11091 | 5/1987 | Japan . |
| 62-133108 | 6/1987 | Japan . |
| 62-268814 | 11/1987 | Japan . |
| 63-50519 | 3/1988 | Japan . |
| 61-610417 | 7/1988 | Japan . |

*Primary Examiner*—James Lowe

[57] ABSTRACT

A polyamide yarn is disclosed which is at least about 85% by weight poly(ε-caproamide) and which has a relative viscosity of greater than 50, a tenacity of at least about 9.3 g/d, a dry heat shrinkage at 160° C. of less than about 3 percent, a modulus of at least about 20 g/d, a toughness of at least about 240 g/d. %, a crystal perfection index of greater than about 82, and a long period spacing of greater than about 100 Å. The process for making the yarn includes drawing of a feed yarn while heating to at least about 185° C. in at least a final draw stage to a draw tension of at least 4.8 g/d, subsequently decreasing the tension while heating to at least about 185° C. to produce a length decrease of between about 13.5 and about 30%, and cooling and packaging the yarn.

11 Claims, 1 Drawing Sheet

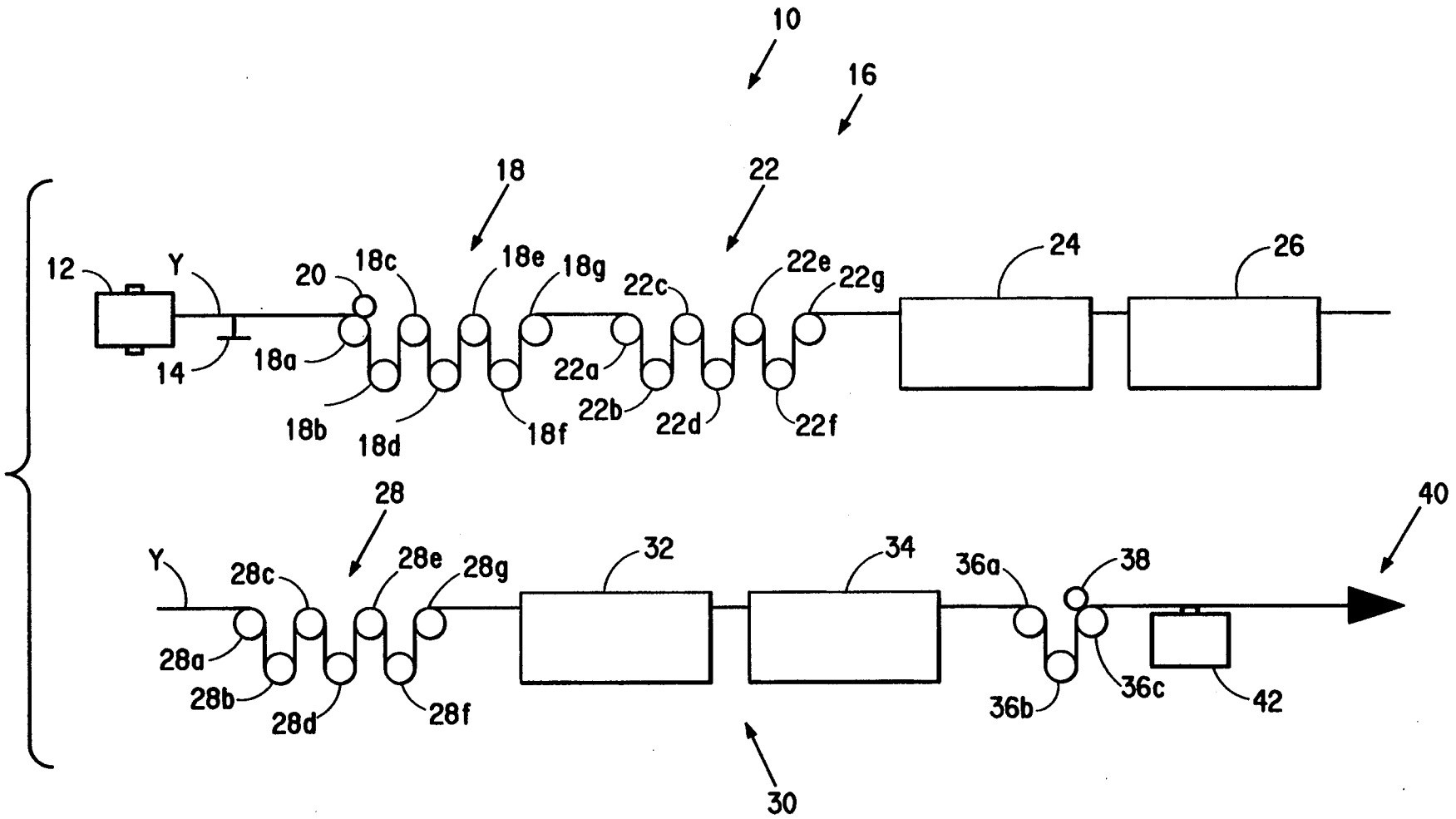
10
16
12
14
Y
20
18a
18b
18c
18d
18e
18f
18g
18
22a
22b
22c
22d
22e
22f
22g
22
24
26
28a
28b
28c
28d
28e
28f
28g
28
Y
32
34
30
36a
36b
36c
38
42
40

PROCESS FOR MAKING LOW SHRINKAGE, HIGH TENACITY POLY(EPSILON-CAPROAMIDE) YARN

This is a division of application Ser. No. 07/424,847, filed Oct. 20, 1989, now U.S. Pat. No. 5,104,969.

BACKGROUND OF THE INVENTION

The present invention relates to industrial polyamide yarns and more particularly relates to high tenacity poly(ε-caproamide) yarn having low shrinkage and a process for making such yarns.

A wide variety of high tenacity polyamide yarns are known and are used commercially for a variety of purposes. Many of such polyamide yarns are useful in cords for tires due to high tenacity, i.e., up to but generally not exceeding 10.5 g/d. Such yarns also have tolerable levels of dry heat shrinkage for conversion to tire cords, typically 5–10% at 160° C.

For certain applications such as ropes, industrial fabrics, airbags, and reinforced rubber goods such as hoses and conveyer belts, yarns with shrinkage less than that found in tire yarns are desirable. While some low shrinkage yarns are known, the tenacity of such yarns generally decreases with decreasing shrinkage. The lower tenacity thus requires the usually undesirable use of heavier deniers or the increased number of yarns in the end-use application. Other low shrinkage yarns with high tenacity levels have been made using processes employing treatment steps such as steaming for relatively long periods after drawing but such processes are usually not well-suited for commercial production. In addition, the yarns made by such processes typically have greatly reduced modulus levels and undesirable growth properties.

A heat-stable polyamide yarn with very low shrinkage while at the same time providing high tenacity would be highly desirable for such applications, particularly with a balance of properties including a low shrinkage tension and good modulus. Such yarns would be even more desirable if the yarns were readily manufactured in a commercially-feasible process.

SUMMARY OF THE INVENTION

In accordance with the invention, a polyamide yarn is provided which is at least about 85% by weight poly(ε-caproamide) and which has a relative viscosity of greater than 50, a tenacity of at least about 9.3 g/d, a modulus of at least about 20 g/d, a toughness of greater than about 240 g/d %, a dry heat shrinkage at 160° C. of less than about 3 percent, a crystal perfection index of greater than about 82, and a long period spacing of greater than about 100 Å.

In accordance with a preferred form of the present invention, the yarn has a dry heat shrinkage of less than about 2%, and a tenacity of at least about 9.5 g/d. Preferred yarns in accordance with the invention have a density of at least 1.145 g/cc, maximum shrinkage tensions of less than about 0.30 g/d and growth of less than 10%. Preferred yarns in accordance with the invention have values for elongation to break of greater than about 25% and toughness values of greater than 250 g/d.%. Sonic modulus is greater than about 62 g/d.

The novel high tenacity yarns in accordance with the invention provide dry heat shrinkages of less than 3 percent while also maintaining an excellent combination of other end-use characteristics including a good modulus level. In addition, the shrinkage tension of preferred yarns does not exceed about 0.30 g/d. Thus, in uses such as in a woven fabric in which the yarns are constrained, the actual shrinkage may be considerably less than the value for the yarns at 160° C.

In accordance with the invention, a process is provided for making an at least about 85% poly(ε-caproamide) yarn having a tenacity of at least about 9.0 g/d, a dry heat shrinkage of less than about 3% and a modulus of at least 20 g/d from a drawn, partially-drawn, or undrawn feed yarn. The process includes drawing the yarn in at least a final draw stage while heating the feed yarn. The drawing and heating is continued until the draw tension reaches at least about 4.8 g/d when the yarn is heated to a yarn draw temperature of at least about 185° C., preferably 190° C. The tension on the yarn is decreased after drawing sufficiently to allow the yarn to decrease in length to a maximum length decrease between about 13.5 and about 30%, preferably between about 15 and about 25%. During the relaxation, the yarn is heated to a yarn relaxation temperature of at least about 185° C., preferably 190° C., when the maximum length decrease is reached.

In a preferred process, the heating during the relaxation is continued for a duration sufficient to cause the yarn to have a crystal perfection index of greater than about 82. Preferably, the decreasing of the tension is performed by decreasing the tension partially in at least an initial relaxation increment to cause an initial decrease in length and then further decreasing the tension to cause the yarn to decrease in a final relaxation increment. In a preferred process, the yarn relaxation temperature is attained by heating in an oven at a temperature between about 220° and 300° C. for between about 0.5 and about 1.0 seconds as the maximum length decrease is reached.

The process of the invention provides a commercially-feasible process in which a warp of multiple feed yarns ends can be converted to yarns with high tenacity, low shrinkage and good modulus. Feed yarns ranging from undrawn to "fully drawn" yarns can be used successfully in the process. When fully drawn yarns are used as feed yarns in the process, the shrinkage of those yarns can be reduced to levels below 3% while other functional properties such as high tenacity, high elongation and good modulus are maintained. When undrawn or partially drawn feed yarns are used, they can be converted to high tenacity, low shrinkage and good modulus yarns.

BRIEF DESCRIPTION OF THE DRAWING

The Figure is a diagrammatical view of a process useful in making preferred yarns in accordance with the present invention.

DETAILED DESCRIPTION

Fiber-forming polyamides useful for yarns in accordance with the invention are at least about 85% by weight poly(ε-caproamide) having a relative viscosity of above about 50 on a formic acid basis and which are typically melt-spinnable to yield high tenacity fibers upon drawing. Preferred polyamides have a relative viscosity of above about 70. Preferably, the polyamide is homopolymer(ε-caproamide), which is also known as 6 nylon or poly(ε-caprolactam).

The tenacity of the yarns in accordance with the invention is at least about 9.3 g/d enabling the yarns to be useful for applications requiring high tenacities. Preferably, the yarn tenacity is at least about 9.5 g/d. In yarns of the invention, yarn tenacities can be as high as about 11.0 g/d or more. The modulus of the yarns is at least about 20 g/d. Modulus values of up to about 35 g/d or more are possible. The preferred elongation to break is at least about 23% and can be as high as about 35% resulting in toughness values (tenacity×break elongation) of greater than about 240 g/d.%, most preferably above about 250 g/d.%. Toughness can be as high as about 300 g/d.% or more.

The denier of the yarns will vary widely depending on the intended end use and the capacity of the equipment used to make the yarns. Typical deniers are, for example, on the order of 100–4,000 denier. The denier per filament (dpf) can also range widely but is generally between about 1 and about 30 denier for most industrial applications, preferably between about 3 and about 7 dpf.

The dry heat shrinkage of the yarns of the invention is less than 3.0% at 160° C. making the yarns particularly well-suited for applications where low shrinkage is desirable. Preferably, the shrinkage is less than about 2.0%. In general, it is very difficult to decrease the shrinkage below about 0.3% and still maintain high tenacity and high modulus and thus a preferred shrinkage range is between about 0.3% and about 2.0%. For yarns of the invention, shrinkage tensions are exceedingly low at typical temperatures of use since maximum shrinkage tensions do not occur until close to the melting point of the polymer, i.e., greater than about 210° C. Maximum shrinkage tension is preferably less than about 0.30 g/d and most preferably less than about 0.25 g/d. Shrinkage tension levels in yarns of the invention can be as low as about 0.15 g/d or less. Growth of preferred yarns is less than about 10% and can be as low as 6% or less.

The combination of high tenacity, low shrinkage and good modulus in yarns in accordance with the invention, as well as other useful properties, are due to the novel fine structure of the fiber. The novel fine structure is characterized by a combination of properties including a crystal perfection index (CPI) greater than about 82 which has not previously been observed in poly(ε-caproamide) fibers. A long period spacing greater than about 100 Å is also characteristic of the fibers of the invention. A normalized long period intension (LPI) of greater than about 2.2 is observed in preferred yarns in accordance with the invention. The apparent crystallite size (ACS) is very large, preferably greater than about 65 Å in the 200 plane. Preferred yarns of the invention have a high density of greater than about 1.145 g/cc and values of birefringence which are greater than about 0.054. Preferred yarns have sonic modulus values which are greater than about 62 g/d.

It is believed that the fiber fine structure functions as follows to provide the combination of high tenacity, low shrinkage, good modulus, low growth and other desirable properties. In a polyamide fibers, there are at least two phases which are functionally connected in series and which are responsible for fiber properties. One of these phases is crystalline and is made made up of crystals which are effectively nodes in a highly one-dimensional molecular network. Connecting the crystals are non-crystalline polymer chain segments. The concentration (i.e. number per unit cross-sectional area) and uniformity of these connector molecules determines the ultimate fiber strength.

In a fiber in accordance with the invention, the crystallinity, as revealed by the exceptionally high crystal density, high crystal perfection index, and high apparent crystal size, is extremely high which reduces the fraction of the fiber susceptible to shrinkage due to thermal retraction of the connector molecules. The fibers have a highly extended structure but with low internal stress structure as revealed by the high birefringence and low shrinkage and shrinkage tension. Furthermore, in the yarns of the invention , it is believed that the connector molecules are organized so that their concentration across planes perpendicular to the fiber axis is at an extremely high level. It is believed that the connector molecules are thereby close enough together laterally that they interfere with each other in a way which reduces shrinkage, while still increasing strength and maintaining modulus.

Yarns in accordance with the invention can be produced from known polyamide yarns in a process in accordance with the invention which includes carefully controlled drawing and relaxation steps. The process is advantageously practiced using a warp of a multiplicity of feed yarn ends to improve economics relating to the production of the yarns of the invention.

As will become more apparent hereinafter, feed yarns for producing yarns of the invention must be of good quality and can be "fully" drawn, partially drawn, or undrawn polyamide yarns. Good quality feed yarns, that is, yarns with few broken filaments, with low along-end denier variability, and comprised of polymer containing little or no nonessential materials such as delusterants or large spherulites are essential for acceptable process continuity. "Fully " drawn is intended to refer to yarns having properties corresponding to yarns which are drawn to a high tenacity level for an intended end use in a currently-used, commercially-practical manufacturing process. Typical commercially-available "fully" drawn yarns suitable for use as feed yarns have a tenacity of about 8–10.5 g/d and have a birefringence of about 0.050–0.060. Partially drawn and undrawn feed yarns are typically not widely available commercially but are well-known in the art. Partially drawn yarns have been drawn to some extent but generally are not useful without further drawing. Such partially drawn yarns typically have a birefringence of about 0.015–0.030. Undrawn is intended to refer to yarn which has been spun and quenched but has not been drawn subsequently to quenching. Typically, the birefringence of undrawn yarns is on the order of about 0.008.

Referring now to the Figure, apparatus 10 is illustrated which can be employed in a process of the invention to make yarns in accordance with the invention from "fully" drawn, partially drawn or undrawn feed yarns. While a single end process is shown and described hereinafter, the process is directly applicable to a multiple end process in which a warp of a multiplicity of feed yarns is employed to improve economy. With reference to the Figure, feed yarn Y is led from a supply package 12, passed through a suitable yarn tension control element 14, and enters a draw zone identified generally by the numeral 16.

In the draw zone 16, feed yarns are drawn while being simultaneously heated in at least a final draw stage as will become more apparent hereinafter. The drawing and heating is performed until a draw tension of at least about 4.8 g/d is applied to the yarn when the yarn has been heated to the yarn draw temperature of at least about 185° C. Preferably, the yarn draw temperature is at least about 190° C. To achieve this, different drawing steps, differing total draw ratios and different heating patterns are used for differing feed yarns. For example, a total draw of 6.5× or more with an initial unheated draw stage may be necessary for undrawn yarns while a draw of 1.1–1.3× may be suitable for "fully" drawn yarns. Partially drawn yarns may be drawn to some intermediate ratio. In the drawing of all the feed yarn types, the tenacity during the final draw stage, if measured, generally will increase to greater than the initial tenacity of a typical "fully" drawn yarn by about 10% to 30%, i.e., to about 10.5–12.5 g/d.

In the final draw stage, the drawing is preferably performed in increments as the yarn is heated. Drawing can be begun on heated rolls with a series of successive drawing steps. Due to the high temperatures to be reached when the draw tension is at least about 4.8 g/d, non-contact heating of the yarn is preferred. Such heating can be accomplished in a forced-air oven, an infrared or microwave heater, etc., with heating in an oven being preferred.

Referring again to the Figure, the drawing of the yarn Y in draw zone 16 of the process illustrated begins as the yarn passes in a serpentine fashion through a first set of seven draw rolls identified collectively as 18 and individually as **18*a*–18*g*. These rolls are suitably provided by godet rolls which have the capability of being heated such as by being internally-heated by the circulation of heated oil. In addition, the rotational velocity of the rolls is controlled to impart a draw of typically 0.5% to 1% to the yarn between each successive roll in the set of rolls to draw the yarn slightly and to maintain tight contact of the yarn with the rolls. The yarn Y is pressed against the first roll 18*a* by a nip roll 20** to prevent slippage.

Yarn Y is then forwarded to a second set 22 of seven draw rolls **22*a*–22*g* which are internally heated and the rotational velocity of which is controlled similarly to the first roll set 18. Typically, the rotational velocity of the rolls is controlled to impart a draw of typically 0.5% to 1% to the yarn between each successive roll in the set of rolls as in the first roll set. The velocity difference between the first roll set 18 and the second roll set 22 (between roll 18*a*and roll 22*a*) can be varied to draw the yarn as it advances between the sets of rolls. For undrawn feed yarns, a majority of the draw, e.g., 2.5–4.5× is usually performed in an initial "space" draw area between the first and second roll sets with only moderate or no heating of the first roll set 18. For "fully" drawn feed yarns, substantially no draw is typically imparted to the yarn between the first and second roll sets 18 and 22 and the first roll set 18 can be bypassed if desired although it is useful to run the yarn through the nip of rolls 18*a* and 20 to establish positive engagement of the yarn and avoid slippage during later drawing. Partially drawn yarns generally should be drawn as needed in the space draw zone so that the overall draw experienced by the yarns after space drawing is similar to or somewhat less than "fully" drawn feed yarns. Usually, for all feed yarns types, the second roll set 22** is used to heat the yarn by conduction in preparation for the final drawing at elevated temperature, e.g., roll temperatures of typically about 150°–215° C.

After advancing past the second roll set 22, the yarn Y enters a heated draw area provided by two ovens, 24 and 26, respectively, which can be the forced hot air type with the capability to provide oven temperatures of at least about 300° C. The final draw stage which achieves the maximum draw of the process is performed in the heated draw area. The residence time and the temperature of the ovens is such that the yarn Y is heated to at least about 185° C. but the yarn temperature cannot exceed or approach the polyamide melting point too closely. To accomplish the heating effectively, the oven temperatures may exceed the yarn temperatures by as much as 130° C. at typical process speeds. The yarn temperatures for the poly(ϵ-caproamide) yarns of the invention are preferably between about 185° and about 215° C. Preferred oven temperatures for the poly(ϵ-caproamide) yarns are between about 220° and about 300° C. with a residence time of between about 0.5 and about 1.0 seconds. The draw in the heated draw area is determined by the speed of the first roll **22*a* in the second roll set 22 and the first roll 28*a* of the third roll set 28 (seven rolls 28*a*–28*g*) through which the yarn Y advances in a serpentine fashion after leaving the ovens 24 and 26. The total draw for the process is determined by the velocity of the first roll 18*a* in the first roll set and the speed of the first roll 28*a* in the third roll set. This first roll 28*a* in the third roll set marks the end of the draw zone 16 since, unlike the first and second roll sets, the velocity of successive rolls of roll set 28 decreases by between 0.5–1.0% as the yarn advances. Thus, a relaxation zone of the process, which is identified generally by the numeral 30, begins at roll 28*a***.

In the relaxation zone 30, the yarn is relaxed in a controlled fashion (the tension is decreased and the yarn is allowed to decrease in length) by between about 13.5 and about 30%. Preferably, the decrease in length is between about 15 and about 25%. The yarn is heated during the relaxation so that a yarn relaxation temperature of above about 185° C. is reached. To assist in maintaining process continuity during relaxation and maintain good modulus and low growth in the product, a small tension should be maintained on the yarn, typically above about 0.1 g/d.

The relaxation is preferably performed in increments as the yarn is heated. The initial relaxation can be performed on heated rolls and advantageously is a series of successive relaxation steps within the initial relaxation increment. Due to the high temperatures necessary during the final relaxation increment, non-contact heating of the yarn is preferred, preferably in an oven. In the preferred process, the heating during relaxation is continued for a duration sufficient to cause the yarn to have a crystal perfection index of greater than about 82.

As illustrated in the Figure, the relaxation in the preferred process illustrated is performed initially by the incremental relaxation on the third roll set 28 the rolls of which are heated to about 150°–215° C. The yarn then passes through relaxation ovens 32 and 34 capable of providing maximum oven temperatures of at least about 300° C. during which the maximum relaxation occurs. Achieving the necessary relaxation temperature depends on the oven temperature and residence time of the yarn in the ovens. Preferably, the ovens contain air at temperatures in excess of the yarn temperature by as much as about 130° C. for effective heating at reasonable process speeds. Yarn temperatures for the poly ((ϵ-caproamide) yarns of the invention are preferably between about 185° and about 215° C. Preferred oven temperatures for the poly(ϵ-caproamide) yarns are between about 220° and about 300° C. with a residence time of between about 0.5 and about 1.0 seconds.

After the yarn passes through the ovens 32 and 34, yarn Y then passes through a fourth roll set 36 of 3 rolls (36a–36c) in a serpentine fashion with the yarn Y being pressed against the last roll 36c by nip roll 38 to prevent slippage. The surfaces of the fourth roll set 36 can be internally cooled with chilled water to assist in reducing the yarn temperature to a level suitable for wind-up. The yarn is retensioned slightly on roll 36c in order to produce a stable running yarn and avoid wraps on roll 36b. The total relaxation is thus determined by the velocity difference between the first roll 28a of the third roll set 28 and the first roll 36a of the fourth roll set 36.

After leaving the relaxation zone 30 of the process, the yarn Y is fed through a yarn surface treatment zone 40 which can include an interlace jet (not shown) to commingle the yarn filaments, a finish applicator 42 to apply a yarn finish or other treatments to the yarn. At a wind-up station (not shown), the multiple ends of yarn Y are wound up onto suitable packages for shipping and end use.

In a process in accordance with the invention using apparatus as illustrated for a warp of multiple ends, preferred wind-up speeds are from 150 mpm to 750 mpm.

The following examples illustrate the invention and are not intended to be limiting. Yarn properties are measured in accordance with the following test methods. Percentages are by weight unless otherwise indicated.

TEST METHODS

Conditioning: Packaged yarns were conditioned before testing for at least 2 hours in a 55% ±2% relative humidity, 74° F. ±2° F. (23° C. ±1° C.) atmosphere and measured under similar conditions unless otherwise indicated.

Relative Viscosity: Relative viscosity refers to the ratio of solution and solvent viscosities measured in a capillary viscometer at 25° C. The solvent is formic acid containing 10% by weight of water. The solution is 8.4% by weight polyamide polymer dissolved in the solvent.

Denier: Denier or linear density is the weight in grams of 9,000 meters of yarn. Denier is measured by forwarding a known length of yarn, usually 45 meters, from a multifilament yarn package to a denier reel and weighing on a balance to an accuracy of 0.001 g. The denier is then calculated from the measured weight of the 45 meter length.

Tensile Properties: Tensile properties (Tenacity, Elongation at break and Modulus) are measured as described by Li in U.S. Pat. No. 4,521,484 at col. 2, line 61 to col. 3, line 6, the disclosure of which is hereby incorporated by reference.

Initial modulus is determined from the slope of a line drawn tangential to the "initial" straightline portion of the stress strain curve. The "initial" straightline portion is defined as the straightline portion starting at 0.5% of full scale load. For example, full scale load is 50.0 pounds for 600–1,400 denier yarns; therefore the "initial" straightline portion of the stress-strain curve would start at 0.25 lbs. Full scale load is 100 pounds for 1,800–2,000 denier yarns and the initial straightline portion of the curve would start at 0.50 lbs.

Toughness: Toughness is calculated as the product of the measured tenacity (g/d) and measured elongation at break (%).

Dry Heat Shrinkage: Dry heat shrinkage is measured on a Testrite shrinkage instrument manufactured by Testrite Ltd. Halifax, England. A ~24" (61 cm) length of multifilament yarn is inserted into the Testrite and the shrinkage recorded after 2 minutes at 160° C. under a 0.05 g/d load. Initial and final lengths are determined under the 0.05 g/d load. Final length is measured while the yarn is at 160° C.

Shrinkage Tension: The maximum shrinkage tension and the temperature at maximum shrinkage tension are measured as described in U.S. Pat. No. 4,343,860, col. 11, lines 15 to 33, the disclosure of which is incorporated by reference. In this method a 10 cm loop is heated in an oven at 30° C. per minute and the tension is measured and plotted against temperature to obtain a tension/temperature spectrum. The yarn samples were heated to melting point of the yarn (about 225°–235° C.). The temperature at maximum shrinkage tension and the maximum shrinkage tension or force are read directly off of the tension/temperature spectrum.

Growth: The fiber growth is measured by suspending a 50 to 60 cm length of yarn from a frame, measuring its initial length under a 0.01 g/d load, and then measuring its length after 30 minutes under a 1.0 g/d load. The growth is calculated as a % from the following formula:

$$\% \text{ Growth} = \frac{L(f) - L(i)}{L(i)} \times 100$$

Where L(f) is the final length after 30 minutes and L(i) is the initial length.

Birefringence: The optical parameters of the fibers of this invention are measured according to the method described in Frankfort and Knox U.S. Pat. No. 4,134,882 beginning at column 9, line 59 and ending at column 10, line 65, the disclosure of which is incorporated by reference, with the following exceptions and additions. First, instead of Polaroid T-410 film and 1000× image magnification, high speed 35 mm film intended for recording oscilloscope traces and 300× magnification are used to record the interference patterns. Also suitable electronic image analysis methods which give the same result can also be used. Second, the word "than" in column 10, line 26 is replaced by the word "and" to correct a typographical error.

X-Ray Parameters

Crystal Perfection Index and Apparent

Crystallite Size: Crystal perfection index and apparent crystallite size are derived from X-ray diffraction scans. The diffraction pattern of fibers of these compositions is characterized by two prominent equatorial X-ray reflections with peaks occurring at scattering angle approximately 20°–21° and 23°2θ.

X-ray diffraction patterns of these fibers are obtained with an X-ray diffractometer (Philips Electronic Instruments, Mahway, N.J., cat. no. PW1075/00) in reflection mode, using a diffracted-beam mono-chromator and a scintillation detector. Intensity data are measured with a rate meter and recorded by a computerized data collection/reduction system. Diffraction patterns are obtained using the instrumental settings:

Scanning Speed 1° 2θ per minute;
Stepping Increment 0.025° 2θ;
Scan Range 6° to 35°, 2θ; and
Pulse Height Analyzer, "Differential".

For both Crystal Perfection Index and Apparent Crystallite Size measurements, the diffraction data are processed by a computer program that smoothes the data, determines the baseline, and measures peak locations and heights.

The X-ray diffraction measurement of crystallinity in 66 nylon, 6 nylon, and copolymers of 66 and 6 nylon is the Crystal Perfection Index (CPI) (as taught by P. F. Dismore and W. O. Statton, J. Polym. Sci. Part C, No. 13, pp. 133–148, 1966). The positions of the two peaks at 21° and 23° 2θ are observed to shift, and as the crystallinity increases, the peaks shift farther apart and approach the positions corresponding to the "ideal" positions based on the Bunn-Garner 66 nylon structure. This shift in peak location provides the basis of the measurement of Crystal Perfection in 66 nylon:

$$CPI = \frac{[d(\text{outer})/d(\text{inner})] - 1}{0.189} \times 100$$

where d(outer) and d(inner) are the Bragg 'd' spacings for the peaks at 23° and 21° respectively, and the denominator 0.189 is the value for d(100)/d(010) for well-crystallized 66 nylon as reported by Bunn and Garner (Proc. Royal Soc. (London), A189, 39, 1947). An equivalent and more useful equation, based on 2θ values, is:

$$\text{CPI} = [2\theta(\text{outer})/2\theta(\text{inner}) - 1] \times 546.7$$

Because 6 nylon has a different crystallographic unit cell, the factor for well-crystallized 6 nylon is different, and the equation is:

$$\text{CPI} = [2\theta(\text{outer})/2\theta(\text{inner}) - 1] \times 509.8$$

Apparent Crystallite Size: Apparent crystallite size is calculated from measurements of the half-height peak width of the equatorial diffraction peaks. Because the two equatorial peaks overlap, the measurement of the half-height peak width is based on the half-width at half-height. For the 20°–21° peak, the position of the half-maximum peak height is calculated and the 2θ value for this intensity is measured on the low angle side. The difference between this 2θ value and the 2θ value at maximum peak height is multiplied by two to give the half-height peak (or "line") width. For the 23° peak, the position of the half-maximum peak height is calculated and the 2θ value for this intensity is measured on the high angle side; the deference between this 2θ value and the 2θ value at maximum peak height is multiplied by two to give the half-height peak width.

In this measurement, correction is made only for instrumental broadening; all other broadening effects are assumed to be a result of crystallite size. If 'B' is the measured line width of the sample, the corrected line width 'beta' is $$\beta = \sqrt{B^2 - b^2}$$

where 'b' is the instrumental broadening constant. 'b' is determined by measuring the line width of the peak located at approximately 28° 2θ in the diffraction pattern of a silicon crystal powder sample.

The Apparent Crystallite Size (ACS) is given by $$\text{ACS} = (K\lambda)/(\beta \cos \theta), \text{ wherein}$$

K is taken as one (unity);

λ is the X-ray wavelength (here 1.5418 Å);

β is the corrected line breadth in radians; and

θ is half the Bragg angle (half of the 2θ value of the selected peak, as obtained from the diffraction pattern).

X-ray Orientation Angle: A bundle of filaments about 0.5 mm in diameter is wrapped on a sample holder with care to keep the filaments essentially parallel. The filaments in the filled sample holder are exposed to an x-ray beam produced by a Philips X-ray generator (Model 12045B) available from Philips Electronic Instruments. The diffraction pattern from the sample filaments is recorded on Kodak DEF Diagnostic Direct Exposure X-ray film (Catalogue Number 154-2463), in a Warhus pinhole camera. Collimators in the camera are 0.64 mm in diameter. The exposure is continued for about fifteen to thirty minutes (or generally long enough so that the diffraction feature to be measured is recorded at an Optical Density of ~1.0). A digitized image of the diffraction pattern is recorded with a video camera. Transmitted intensities are calibrated using black and white references, and gray level (0–255) is converted into optical density. The diffraction pattern of 66 nylon, 6 nylon, and copolymers of 66 and 6 nylon has two prominent equatorial reflections at 2θ approximately 20°–21° and 23°; the outer (~23°) reflection is used for the measurement of Orientation Angle. A data array equivalent to an azimuthal trace through the two selected equatorial peaks (i.e. the outer reflection on each side of the pattern) is created by interpolation from the digital image data file; the array is constructed so that one data point equals one-third of one degree in arc.

The Orientation Angle (OA) is taken to be the arc length in degrees at the half-maximum optical density (angle subtending points of 50 percent of maximum density) of the equatorial peaks, corrected for background. This is computed from the number of data points between the half-height points on each side of the peak (with interpolation being used, this is not an integral number). Both peaks are measured and the Orientation Angle is taken as the average of the two measurements.

Long Period Spacing and Normalized Long Period Intensity: The long period spacing (LPS), and long period intensity (LPI), are measured with a Kratky small angle diffractometer manufactured by Anton Paar K.G., Graz, Austria, The diffractometer is installed at a line-focus port of a Philips XRG3100 x-ray generator equipped with a long fine focus X-ray tube operated at 45KV and 40 ma. The X-ray focal spot is viewed at a 6 degree take-off angle and the beam width is defined with a 120 micrometer entrance slit. The copper K-alpha radiation from the X-ray tube is filtered with a 0.7 mil nickel filter and is detected with a NaI(TI) Scintillation counter equipped with a pulse height analyzer set to pass 90% of the CuK-alpha radiation symmetrically.

The nylon samples are prepared by winding the fibers parallel to each other about a holder containing a 2 cm diameter hole. The area covered by the fibers is about 2 cm by 2.5 cm and a typical sample contains about 1 gram of nylon. The actual amount of sample is determined by measuring the attenuation by the sample of a strong CuK-alpha X-ray signal and adjusting the thickness of the sample until the transmission of the x-ray beam is near 1/e or 0.3678. To measure the transmission, a strong scatterer is put in the diffracting position and the nylon sample is inserted in front of it, immediately beyond the beam defining slits. If the measured intensity without attenuation is Io and the attentuated intensity is I, then the transmission T is I/(Io). A sample with a transmission of 1/e has an optimum thickness since the diffracted intensity from a sample of greater or less thickness than optimum will be less than that from a sample of optimum thickness.

The nylon sample is mounted such that the fiber axis is perpendicular to the beam length (or parallel to the direction of travel of the detector). For a Kratky diffractometer viewing a horizontal line focus, the fiber axis is perpendicular to the table top. A scan of 180 points is collected between 0.1 and 4.0 degrees $2\theta$, as follows: 81 points with step size 0.0125 degrees between 0.1 and 1.1 degrees; 80 points with step size 0.025 degrees between 1.1 and 3.1 degrees; 19 points with step size 0.05 degrees between 3.1 and 4.0 degrees. The time for each scan is 1 hour and the counting time for each point is 20 seconds. The resulting data are smoothed with a moving parabolic window and the instrumental background is subtracted. The instrumental background, i.e. the scan obtained in the absence of a sample, is multiplied by the transmission, T, and subtracted, point by point, from the scan obtained from the sample. The data points of the scan are then corrected for sample thickness by multiplying by a correction factor, $CF=-1.0/(eT\ln(T))$. Here e is the base of the natural logarithm and ln(T) is the natural logarithm of T. Since T is less than 1, ln(T) is always negative and CF is positive. Also, if $T=1/e$, then $CF=1$ for the sample of optimum thickness. Therefore, CF is always greater than 1 and corrects the intensity from a sample of other than optimum thickness to the intensity that would have been observed had the thickness been optimum. For sample thicknesses reasonably close to optimum, CF can generally be maintained to less than 1.01 so that the correction for sample thickness can be maintained to less than a percent which is within the uncertainty imposed by the counting statistics.

The measured intensities arise from reflections whose diffraction vectors are parallel tot he fiber axis. For most nylon fibers, a reflection is observed in the vicinity of 1 degree $2\theta$. To determine the precise position and intensity of this reflection, a background line is first drawn underneath the peak, tangent to the diffraction curve at angles both higher and lower than the peak itself. A line parallel to the tangent background line is then drawn tangent to the peak near is apparent maximum but generally at a slightly higher $2\theta$ value. The $2\theta$ value at this point of tangency is taken to be the position since it is position of the maximum if the sample background were subtracted. The long period spacing, LPS, is calculated from the Bragg Law using the peak position thus derived. For small angles this reduces to:

$$LPS=\lambda/\sin(2\theta)$$

The intensity of the peak, LPI, is defined as the vertical distance, in counts per second, between the point of tangency of the curve and the background line beneath it.

The Kratky diffractometer is a single beam instrument and measured intensities are arbitrary until standardized. The measured intensities may vary from instrument to instrument and with time for a given instrument because of x-ray tube aging, variation in alignment, drift, and deterioration of the scintillation crystal. For quantitative comparison among samples, measured intensities were normalized by ratioing with a stable, standard reference sample. This reference was chosen to be a "fully drawn" nylon 66 yarn identified as T-717 and commercially available from the E. I. du Pont de Nemours and Company, Wilmington, Del.

Sonic Modulus: Sonic Modulus is measured as reported in Pacofsky U.S. Pat. No. 3,748,844 at col. 5, lines 17 to 38, the disclosure of which is incorporated by reference except that the fibers are conditioned for 24 hours at 70° F. (21° C.) and 65% relative humidity prior to the test and the nylon fibers are run at a tension of 0.1 grams per denier rather than the 0.5–0.7 reported for the polyester fibers of the referenced patent.

Density: Density of the polyamide fiber is measured by use of the density gradient column technique described in ASTM D150556-68 using carbon tetrachloride and heptane liquids at 25° C.

Tension: While the process is running, tension measurements are made in the draw zone and relax zones (in the Figure, after oven 26 in the draw zone and after oven 34 in the relaxation zone about 12 inches (30 cm) from the exits of the ovens) using model Checkline DXX-40, DXX-500, DXX-1K and DXX-2K hand-held tensiometers manufactured by Electromatic Equipment Company, Inc., Cedarhurst, N.Y. 11516.

Yarn Temperature: Yarn Temperatures are measured after the yarn leaves draw oven 26 and relaxation oven 34 with the measurements made about 4 inches (10 cm) away from the oven exit. The measurements are made with a non-contact infrared temperature measurement system comprised of an infrared optical scanning system with a 7.9 micron filter (band pass of about 0.5 microns) and broad band detector to sense the running yarn and a temperature reference blackbody placed behind the yarn which can be precisely heated to temperatures up to 300° C. A type J thermocouple, buried in the reference, is used with a Fluke Model 2170A digital indicator traceable to National Bureau Standards to measure the reference temperature. Highly accurate measurement of the temperature of polyamide yarn is obtained since the 7.9 micron filter corresponds to an absorption band where the emissivity is known to be close to unity. In practice, the temperature of the reference is adjusted so that the yarn line scan image disappears as viewed on an oscilloscope and , at this null point, the yarn will be at the same temperature as the reference.

EXAMPLE 1

A commercially-available fully drawn 1882 denier, 304 filament poly (ε-caproamide) yarn with a formic acid relative viscosity of about 104 was used as a feed yarn in a process as illustrated in the Figure. A partial listing of the properties of Feed Yarn 1 is provided in Table 2.

Using apparatus as illustrated in the Figure operated using the process conditions listed in Table 1, a single end of the yarn was taken off a feed package 12 over end, forwarded to the tension control element 14 for tension control, and then nipped by nip roll 20 and godet roll **18*a* of roll set 18. The godet rolls 18*b* through 18*g* of roll set 18 were bypassed and the yarn was forwarded directly to godet rolls 22*a*–22*g* of roll set 22, through ovens 24 and 26, through all seven rolls of roll set 28, through ovens 32 and 34, and through the rolls of roll set 36 before wind-up. Incremental draws of 0.5% were used between each pair of rolls in roll set 22 and incremental relaxations of 0.5% were used between each pair of rolls in the third roll set 28**. The overall draw ratio was 1.221 producing a draw tension of greater than 5.3 g/d at the yarn draw temperature of 212° C.. A temperature of 209° C. was experienced by the yarn during the relaxation of 23.2% in the relaxation zone.

The process speeds, roll and oven temperatures, tensions in the draw and relaxation zones, yarn temperatures and draw/relax ratios are described in more detail in Table 1.

The 1908 denier yarn obtained at wind-up had the same formic acid relative viscosity of 104 but with a tenacity and shrinkage balance of 10.0 g/d and 1.9%, respectively. The modulus was 20.8 g/d and toughness was 283 g/d.%. The crustal perfection index was 82.5, long period spacing was 104 Å, and density was 1.1509. A more detailed list of properties is provided in Table 2.

EXAMPLE 2

The feed yarn for Example 2 was the same as that described in Example 1 and the process was similar to Example 1 but with the process conditions as described in Table 1. The draw tension was >5.3 g/d at a yarn temperature of 192° C. after oven 26. The yarn temperature of the yarn emerging from relaxation oven 34 was 192° C. and the relaxation percentage was 15.5%.

The 1900 denier yarn obtained at wind-up had formic acid relative viscosity of 106 but with a tenacity and shrinkage balance of 10.1 g/d and 2.8%, respectively. The modulus was 26.4 g/d and toughness was 250 g/d.%. The crystal perfection index was 86.6, long period spacing was 106 Å, and density was 1.1488. A more detailed list of properties is provided in Table 2.

EXAMPLE 3

The feed yarn for Example 3 was the same as that described in Example 1 and the process was the same as Example 1 but with the process conditions as described in Table 1. The draw tension was >5.3 g/d at a yarn temperature of 192° C. after oven 26. The yarn temperature of the yarn emerging from relaxation oven 34 was 192° C. and the relaxation percentage was 18.2%.

The 1946 denier yarn obtained at wind-up had a formic acid relative viscosity of 107 but with a tenacity and shrinkage balance of 9.5 g/d and 2.2%, respectively. The modulus was 22.8 g/d and toughness was 254 g/d. The crystal perfection index was 89.6, long period spacing was 112 Å, and density was 1.1464. A more detailed list of properties is provided in Table 2.

EXAMPLE 4

The feed yarn for Example 4 was the same as that described in Example 1 and the process was similar to Example 1 but with the process conditions as described in Table 1. The draw tension was >5.3 g/d at a yarn temperature of 192° C. after oven 26. The yarn temperature of the yarn emerging from relaxation oven 34 was 192° C. and the relaxation percentage was 21.1%.

The 1970 denier yarn obtained at wind-up had formic acid relative viscosity of 106 but with a tenacity and shrinkage balance of 9.3 g/d and 1.8%, respectively. The modulus was 21.2 g/d and toughness was 22 g/d.%. The crystal perfection index was 88.6, long period spacing was 114 Å, and density was 1.1492. A more detailed list of properties is provided in Table 2.

TABLE 1

PROCESS CONDITIONS

| Example | Element 14 Tension (g) | Roll 18a Speed (mpm) | Roll 18g Speed (mpm) | Roll 22a Speed (mpm) | Roll 22g Speed (mpm) | Roll 28a Speed (mpm) | Roll 28g Speed (mpm) | Roll 36a Speed (mpm) | Roll 36c Speed (mpm) | 18a-18c Temp. (°C.) | 18d-18g Temp. (°C.) |
|---|---|---|---|---|---|---|---|---|---|---|---|
| 1 | — | 326.0 | — | 349.2 | 359.4 | 398.0 | 386.2 | 323.0 | 324.6 | 25 | 25 |
| 2 | — | 347.7 | — | 349.2 | 359.4 | 398.0 | 386.2 | 345.4 | 346.7 | 25 | 25 |
| 3 | — | 347.7 | — | 349.2 | 359.4 | 398.0 | 386.2 | 336.6 | 338.0 | 25 | 25 |
| 4 | — | 347.7 | — | 349.2 | 359.4 | 398.0 | 386.2 | 328.6 | 330.4 | 25 | 25 |

| Example | 22a-22c Temp. (°C.) | 22d-22g Temp. (°C.) | 28a-28c Temp. (°C.) | 28d-28g Temp. (°C.) | 36a-36c Temp. (°C.) | Oven 24 Temp. (°C.) | Oven 26 Temp. (°C.) | Oven 32 Temp. (°C.) | Oven 34 Temp. (°C.) | 18a-22a Draw Ratio |
|---|---|---|---|---|---|---|---|---|---|---|
| 1 | 150 | 175 | 180 | 200 | 25 | 280 | 280 | 280 | 280 | 1.009 |
| 2 | 150 | 175 | 200 | 200 | 25 | 260 | 260 | 260 | 260 | 1.004 |
| 3 | 150 | 175 | 200 | 200 | 25 | 260 | 260 | 260 | 260 | 1.004 |
| 4 | 150 | 175 | 200 | 200 | 25 | 260 | 260 | 260 | 260 | 1.004 |

| | | | | | After Oven 26 | | | After Oven 34 | |
|---|---|---|---|---|---|---|---|---|---|
| Example | 22a-28a Draw Ratio | 18a-28a Draw Ratio | 28a-36a Relaxation (%) | Ovens 24 and 26 Residence Time (sec.) | Yarn Temp. (°C.) | Tension (g/d) | Ovens 32 and 34 Residence Time (sec.) | Yarn Temp. (°C.) | Tension (g/d) |
| 1 | 1.210 | 1.221 | 23.2 | .9 | 212 | >5.3 | .9 | 209 | 0.189 |
| 2 | 1.140 | 1.145 | 15.5 | .9 | 192 | >5.3 | .9 | 192 | 0.316 |
| 3 | 1.140 | 1.145 | 18.2 | .9 | 192 | >5.3 | .9 | 192 | 0.247 |
| 4 | 1.140 | 1.145 | 21.1 | .9 | 192 | >5.3 | .9 | 192 | 0.188 |

TABLE 2

PRODUCT PROPERTIES

| Example | RV | Filament Count | Denier | Modulus (g/d) | Yarn Ten. (g/d) | Elongation (%) | Toughness (g/d · %) | Shrinkage (%) @ 160° C. | Growth % | Biref. | CPI |
|---|---|---|---|---|---|---|---|---|---|---|---|
| 1 | 102 | 304 | 1908 | 20.8 | 10.0 | 28.3 | 283 | 1.9 | 9.2 | 0.0565 | 82.5 |
| 2 | 106 | 304 | 1900 | 26.4 | 10.1 | 24.8 | 250 | 2.8 | 7.8 | 0.0558 | 86.6 |
| 3 | 107 | 304 | 1946 | 22.8 | 9.5 | 26.7 | 254 | 2.2 | 8.3 | 0.0556 | 89.6 |
| 4 | 106 | 304 | 1970 | 21.2 | 9.3 | 31.0 | 288 | 1.8 | 9.5 | 0.0552 | 88.6 |
| Feed | 108 | 304 | 1882 | 41.0 | 9.6 | 19.6 | 188 | 9.3 | 6.9 | 0.0583 | 70.7 |

| | ACS (Å) | ACS (Å) | Orientation | LPS | Density | Sonic Modulus | Shrinkage Tension at | Temperature at Maximum Shrinkage |
|---|---|---|---|---|---|---|---|---|

TABLE 2-continued

| PRODUCT PROPERTIES | | | | | | | | | |
|---|---|---|---|---|---|---|---|---|---|
| Example | 200 Pl. | 002 Pl. | Angle (Deg) | (Å) | LPI | (g/cc) | (g/d) | Maximum (g/d) | Tension (°C.) |
| 1 | 69.5 | 40.5 | 15.9 | 104 | 2.47 | 1.1509 | 69.1 | 0.194 | 232 |
| 2 | 78.2 | 41.4 | 15.6 | 106 | 2.62 | 1.1488 | 68.8 | 0.245 | 228 |
| 3 | 82.9 | 44.3 | 15.0 | 112 | 3.12 | 1.1464 | 65.4 | 0.196 | 229 |
| 4 | 81.9 | 43.3 | 15.0 | 114 | 3.62 | 1.1492 | 63.8 | 0.180 | 229 |
| Feed | 56.4 | 34.3 | 14.8 | 95 | 1.25 | 1.1416 | 71.9 | 0.271 | 224 |

We claim:

1. A process for making a polyamide yarn comprised of at least about 85% by weight poly(ε-caproamide) having a tenacity of at least about 9.0 g/d, a dry heat shrinkage of less than about 3.0% and modulus of at least about 20 g/d from a feed yarn selected from the class consisting of drawn, partially-drawn and undrawn yarns, said process comprising:

drawing said feed yarn in at least a final draw stage;

heating said feed yarn during at least said final draw stage;

said drawing and heating of said feed yarn being continued until the draw tension reaches at least about 4.8 g/d when said yarn is heated to a yarn draw temperature of at least about 185° C.;

decreasing the tension on said yarn after said drawing sufficiently to allow said yarn to decrease in length to a maximum length decrease between about 13.5 and about 30%;

heating said yarn during said decreasing of said tension to a yarn relaxation temperature of at least about 185° C., when said maximum length decrease is reached; and cooling and packaging said yarn after said decreasing of said tension.

2. The process of claim 1 wherein said tension is decreased sufficiently that the maximum length decrease of the yarn is between about 15 and about 25%.

3. The process of claim 1 wherein said drawing and heating is continued until said yarn draw temperature reaches at least about 190° C.

4. The process of claim 1 wherein said heating of said yarn during said relaxation is continued until the yarn relaxation temperature reaches at least about 190° C.

5. The process of claim 1 wherein said heating during said decreasing of the tension is continued for a duration sufficient to cause said yarn to have a crystal perfection index of greater than about 82.

6. The process of claim 1 wherein said decreasing of the tension is performed by decreasing the tension partially in at least an initial relaxation increment to cause an initial decrease in length and then further decreasing the tension to cause said yarn to decrease further in length to its maximum length decrease in a final relaxation increment.

7. The process of claim 1 performed on a multiplicity of yarn ends simultaneously at a packaging speed between 150 and 750 mpm.

8. The process of claim 1 wherein said feed yarn is a partially-drawn or undrawn feed yarn and said drawing further comprises at least an initial draw stage before said final draw stage.

9. The process of claim 1 wherein said final yarn draw temperature is between about 190° and about 215° C. and said final yarn relaxation temperature is between about 190° and about 215° C.

10. The process of claim 1 wherein said heating during said drawing is performed in an oven having a temperature of between about 220° and about 300° C., the exposure time in said oven begin between about 0.5 and about 1.0 seconds.

11. The process of claim 1 wherein said heating during said decreasing of the tension is performed in an oven having a temperature of between about 220 ° and about 300° C., the exposure time of said yarn in said oven being between about 0.5 and about 1.0 seconds.

* * * * *